United States Patent [19]

Siebert

[11] 4,394,107

[45] Jul. 19, 1983

[54] TRACTOR MOUNTED FORKLIFT

[75] Inventor: Steve L. Siebert, Clovis, Calif.

[73] Assignee: D & S Manufacturing, Clovis, Calif.

[21] Appl. No.: 318,662

[22] Filed: Nov. 5, 1981

[51] Int. Cl.[3] ..... B66F 9/06

[52] U.S. Cl. ..... 414/631; 187/9 E; 254/279; 414/703

[58] Field of Search ..... 414/629, 631, 703; 74/110; 254/278, 279, 294; 187/9 E; 280/461 A, 460 A, 47.29

[56] References Cited

U.S. PATENT DOCUMENTS

| | | | |
|---|---|---|---|
| 142,443 | 9/1873 | Day | 254/279 X |
| 1,103,788 | 7/1914 | Lichtenberg | 254/279 |
| 2,518,105 | 8/1950 | Werth . | |
| 2,638,237 | 5/1953 | Struthers et al. . | |
| 2,681,623 | 6/1954 | Kane | 74/108 X |
| 2,718,318 | 9/1955 | Schmucker et al. . | |
| 3,127,999 | 4/1964 | Gostomski . | |
| 4,103,796 | 8/1978 | Hare . | |

FOREIGN PATENT DOCUMENTS 1555758 11/1979 United Kingdom .

*Primary Examiner*—Robert J. Spar
*Assistant Examiner*—Donald W. Underwood
*Attorney, Agent, or Firm*—Townsend and Townsend

[57] ABSTRACT

A forklift assembly for use with tractors having a conventional three point hitch includes a frame mounted to the tractor via the three point hitch. Raising and lowering the three point hitch raises and lowers the frame. A tine assembly slides along the lateral sides of the frame. A roller is rotationally mounted between the lateral sides near their upper ends. One end of a first cable is attached to the roller and the cable is wrapped around it in a first direction and the other end is attached to a stationary point on the tractor at a point below the roller. Second cables are each attached to the roller at one end and wrapped in a second direction around the roller and the opposite ends are attached to the tine assembly. Movement of the frame upwardly unwinds the first cable from the roller and winds the second cables onto the roller to raise the tine assembly along the frame. The height the tines are raised is equal to the height travelled by the frame plus the additional height the tine assembly moves relative to the frame.

7 Claims, 3 Drawing Figures

TRACTOR MOUNTED FORKLIFT

BACKGROUND OF THE INVENTION

Tractors are called upon to perform many tasks besides pulling plows. One of these tasks is that of lifting bins of produce from the field for placement within the cargo space of a pick-up truck. There have been numerous lifting devices adapted for use on a tractor for such lifting purposes.

One type of lifting device is a hydraulically operated tractor mounted forklift. The tractor engine provides the power to drive the hydraulic system. These devices can work well but have several drawbacks. They are normally individually custom fitted to each tractor and thus can be used on only a single tractor. They are also expensive and are cumbersome to mount to and remove from the tractor.

Tractors often come with a powered three point hitch, typically employing a pair of power driven lower arms and an upper, stabilizing arm. The arms are pivotally mounted to the tractor so the distal ends of the arms move vertically approximately two to three feet along a relatively large diameter arc. This source of power and motion has been used for various types of mechanical forklifts specially designed for use on tractors having such powered hitches. These machines, exemplified by U.S. Pat. Nos. 2,472,194 and 2,712,389, typically employ either a scissors or a parallelogram type of operating mechanism. However, many of the available tractor mounted forklifts are time consuming to hook up to the tractor and may loose much of their lifting power at their maximum height.

Thus, what has been missing in the prior art is a forklift assembly for use with a three point hitch on a tractor which is inexpensive, simple to mount to and dismount from the tractor, and maintains its lifting capacity regardless of the height of the load.

SUMMARY OF THE INVENTION

A forklift assembly for use with tractors having a conventional three point hitch is disclosed. The forklift assembly includes a generally rectangular, vertically disposed frame and is attached to the tractor via the distal ends of the two lower arms and the upper, stabilizing arm of the three point hitch. The rams of the three point hitch can be raised or lowered in a conventional manner thus raising or lowering the frame of the forklift assembly along a first path.

The frame includes lateral sides having a U-shaped cross-section. The lateral sides define tracks along which a tine assembly slides along a second, generally vertical path. The tine assembly includes vertically disposed guides, which ride along the track, and horizontally extending tines upon which the load rests.

A roller is rotationally mounted between the lateral sides of the frame near the upper end of the frame. One end of a first cable is attached to the roller and the cable is wrapped around it in a first direction. The other end of the first cable is attached to a stationary point on the tractor at a point below a roller. A pair of second cables are each attached to the roller at one end and are wrapped in a second direction around the roller. The opposite ends of the second cables are attached to the tine assembly.

Upward movement of the arms of the three point hitch moves the frame upwardly to unwind the first cable from the roller causing the second cables to be wound onto the roller. The tine assembly and the tines therewith therefore move upwardly along the tracks on the frame. The height to which the tines are raised is equal to the height travelled by the frame plus the additional height resulting from the travel of the tine assembly upwardly along the tracks on the frame. The tines are typically raised to about twice the height that the frame is raised.

A primary advantage of the present invention is that it provides a lifting force which is generally insensitive to the height of the load. A forklift assembly made according to the invention is much simpler and much less expensive than hydraulic forklift assemblies, is much easier to mount to and dismount from tractors than hydraulic forklift assemblies, can be used with many different tractors and need not be custom fitted to any particular tractor.

The roller diameter upon which the first and second cables are wrapped is typically constant so that the tine assembly is raised approximately twice the distance that the frame is raised. However, by varying the diameters of the portions of the roller about which the cables are wrapped, this two-to-one ratio can be easily increased or decreased. Of course, increasing the ratio will have the effect of reducing the maximum load which can be lifted. Thus a single assembly having interchangeable rollers can be used according to the height requirements and the maximum loads to be lifted.

Other features and advantages of the invention will appear from the following description in which the preferred embodiment has been set forth in detail in conjunction with the accompanying drawings.

DETAILED DESCRIPTION OF THE PREFERRED EMBODIMENT

Figure 1:
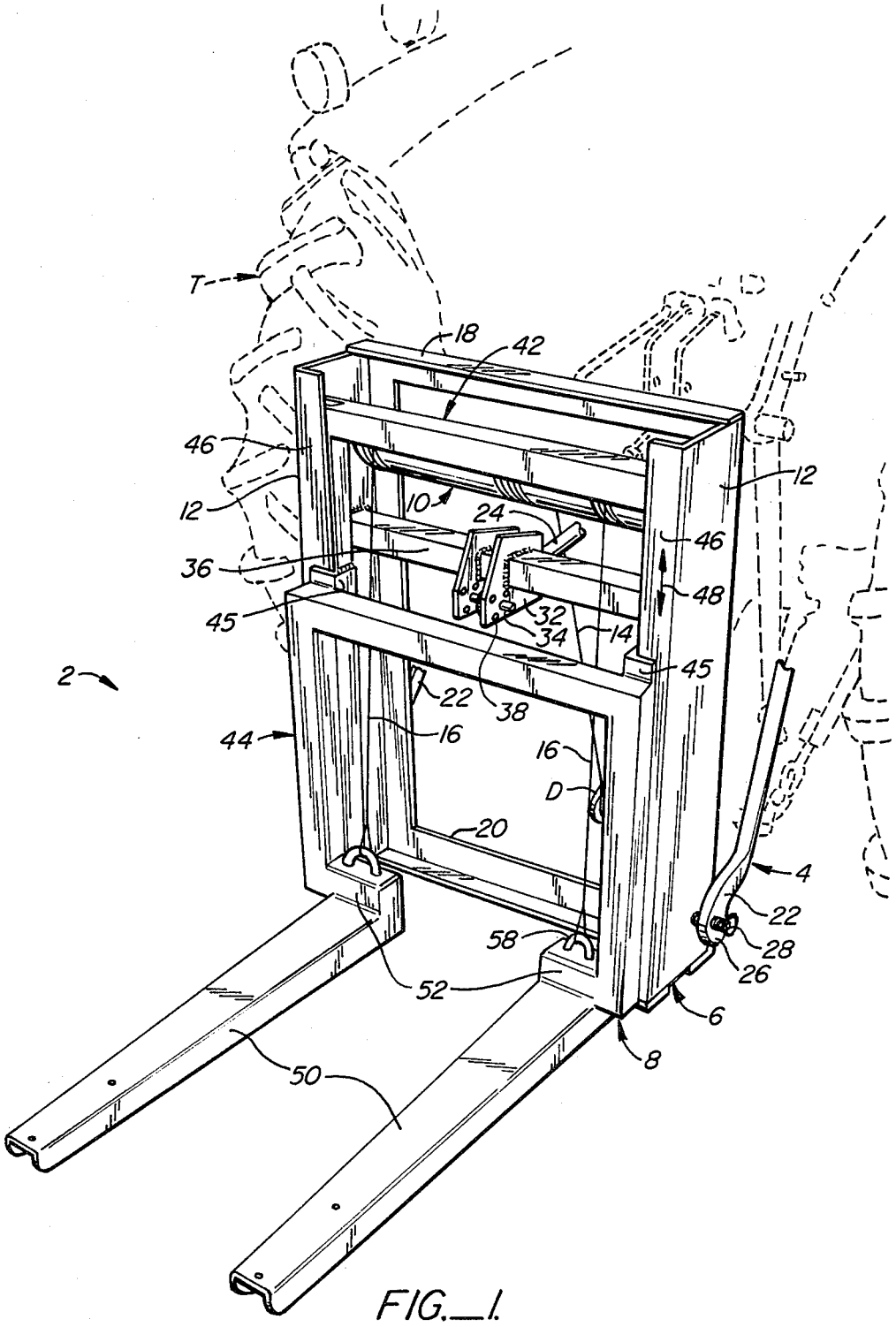
FIG. 1 is a perspective view of the forklift assembly of the present invention mounted to a three point hitch on a tractor.

The figures show a forklift assembly 2 mounted to a tractor T via a three point hitch 4. Assembly 2 includes generally a frame 6, a tine assembly 8 slidably mounted along the frame, a roller 10 mounted between the lateral sidewalls 12 of frame 6 and first and second cables 14, 16. One end of each of the cables is attached to roller 10 and is wound onto and unwound from the roller as described in more detail below.

Sidewalls 12 are U-shaped channel members connected by their upper and lower ends by angle irons 18, 20. Three point hitch 4 includes a pair of lower arms 22 and an upper stabilizing arm 24. Hitch 4 is a conventional part of tractor T. Caps 25 keep tine assembly 8 from sliding off the lower end of frame 6. The distal ends 26 of lower arms 22 are pivotally attached to the lower ends of sidewalls 12 using pins 28 passing through complementarily shaped holes in arm 22 and sidewalls 12. The distal end 30 of upper arm 24 is mounted between a pair of plates 32 using a pin 34 passing through complementarily shaped holes in arm 24 and plates 32. Plates 32 are rigidly mounted to a rectangular tubular brace 36 fixed between sidewalls 12. Plates 32 have a number of holes 38 to accommodate attachment to different tractors.

Thus far described, ignoring for the moment the action of cables 14 and 16, upward movement of distal ends 26, 30 of arms 22, 24 along a somewhat arcuate, generally vertical first path 40 will raise assembly 2 and thus tine assembly 8 a corresponding vertical distance. However, as is discussed below, by the use of the apparatus of the invention disclosed in the figures, tine assembly 8 is raised approximately twice as far as frame 6 is raised.

Tine assembly 8 includes generally rectangular inner and outer guides 42, 44 which are connected by angle irons 45 and which surround the outer flanges 46 of channel-shaped lateral sidewalls 12. Outer flanges 46 thus serve as a guide or track defining a second, generally vertical path 48 along which tine assembly 8, guided by inner and outer guides 42, 44, can move. A pair of tines 50 extend horizontally from extensions 52 which are attached to the lower ends of outer guide 44.

One end of first cable 14 is attached to roller 10 at a central location and is wound thereabout in a first direction 54. The other end of cable 14 is attached to the end of a drawbar D on the tractor. Drawbar D acts as an essentially stationary anchor point. Second cables 16 each have one end attached to roller 10 and are wrapped around roller 10 in a second direction 56. The other ends of second cables 16 are attached to mounting eyes 56 which are welded or otherwise attached to extensions 52 of tine assembly 8.

Figure 2:
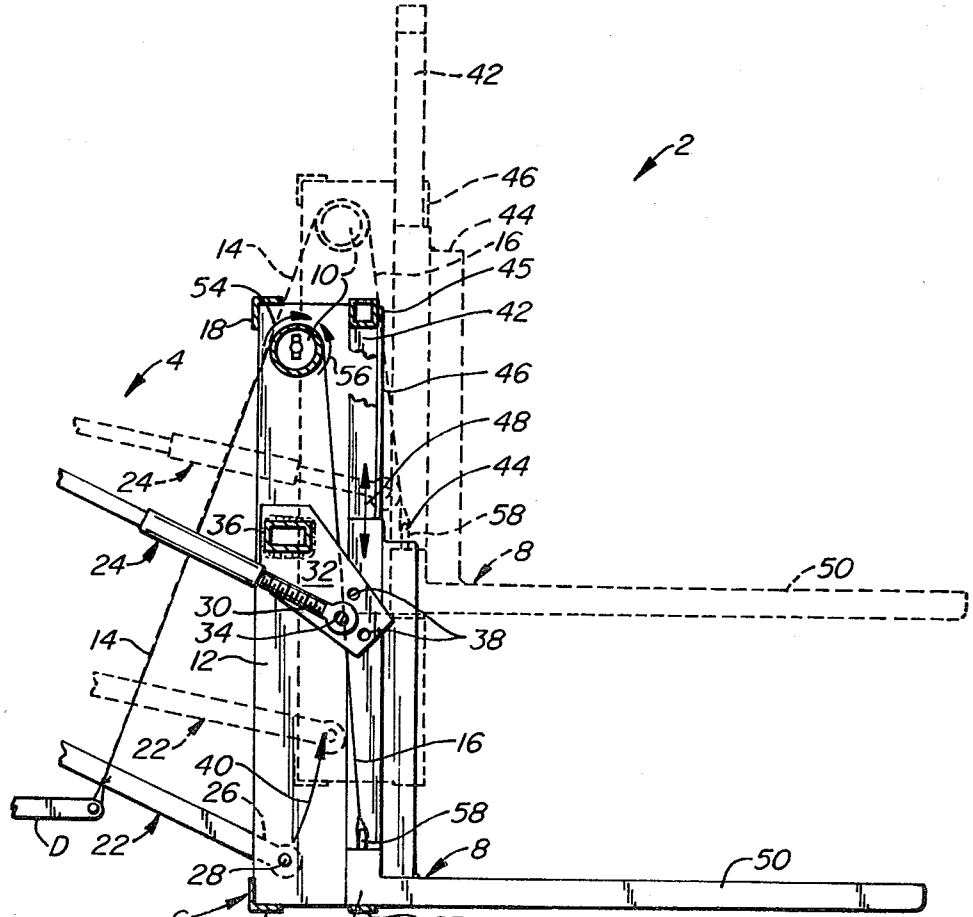
FIG. 2 is a cross-sectional side view of the forklift assembly of FIG. 1 shown in its lowered position using solid lines and shown in its raised position using broken lines.
Figure 3:
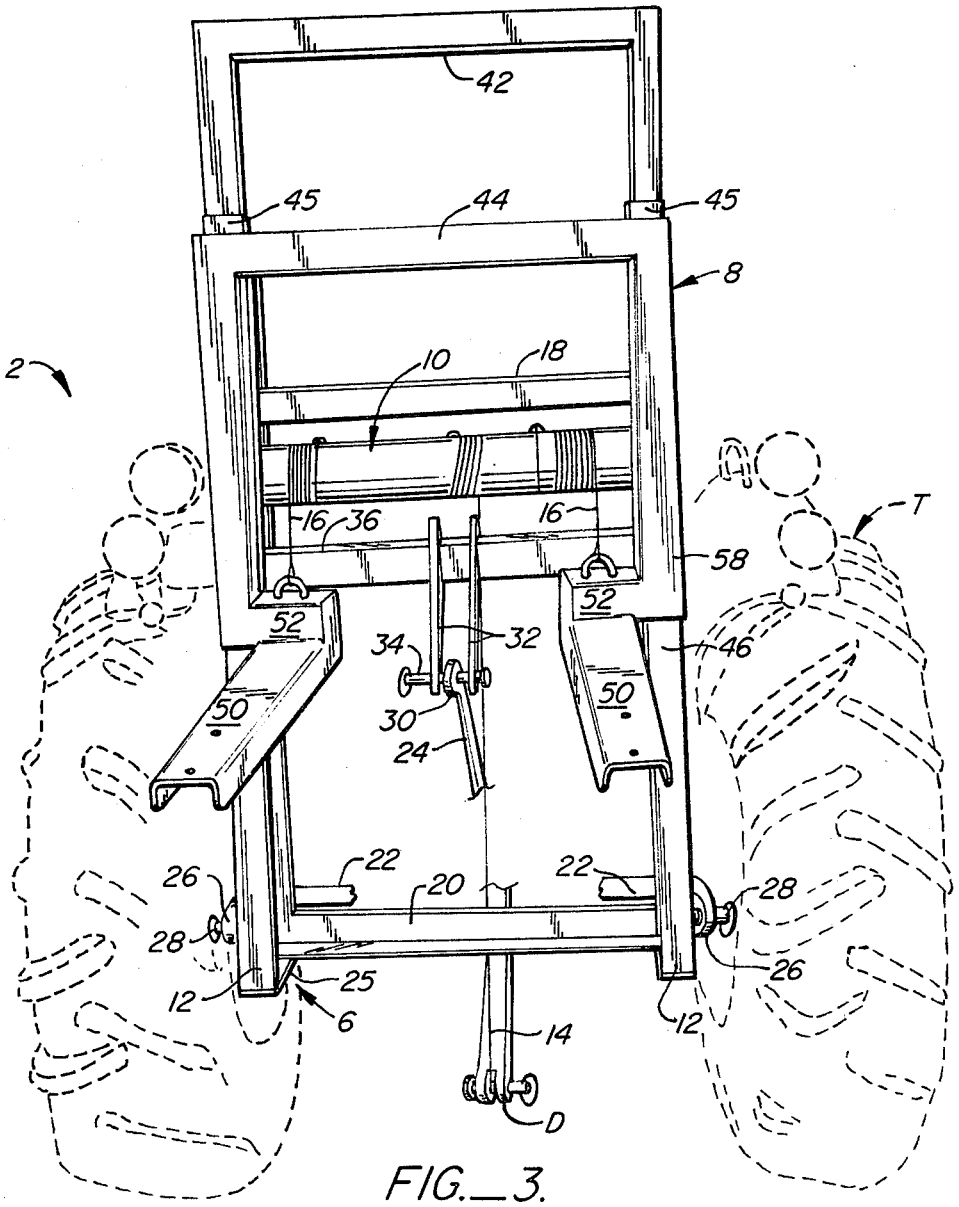
FIG. 3 is a front perspective view of the apparatus of FIG. 1 shown in its raised position.

In use the distal ends 26, 30 of arms 22, 24 are mounted to frame 6 and cable 14 is connected to drawbar D. Raising three point hitch 4 causes frame 6 to move upwardly along first path 40 thus raising tines 50, upon which the load has been placed, a like distance. As frame 6 moves upwardly, the distance between drawbar D and roller 10 increases causing first cable 14 to unwind from roller 10 to turn the roller in the direction of arrow 56 causing a portion of second cable 16 to be wound around roller 10. This causes tine assembly 8 to move upwardly parallel to second path 48. Since the diameter of roller 10 is constant, the length of cable 14 unwound from roller 10 is equal to the length of each second cable 16 wound onto roller 10. As can be seen with reference to FIG. 2, raising frame 6 results in tines 50 being raised a distance approximately double that which the frame is raised.

Modification and variation can be made to the disclosed embodiment without departing from the subject of the invention as defined in the following claims. For example, first cable 14 can be anchored to the tractor at a position other than on drawbar D. Roller 10 can be provided with differing diameters, one for first cable 14 and another for second cables 16, to change the relative movement of tines 50 to frame 6. Further, if desired the area about which cable 14 is wound could be tapered to result in a variable ratio of relative movement. Other means for changing the mechanical advantage, such as using pulleys along the cables, can be used as well. In addition, chains can be used in lieu of second cables 16 and sprockets, for the take-up of the chains, can be mounted to roller 10 to raise tine assembly 8 along frame 6. Other means for raising tine assembly 8, such as through a rack and gear arrangement mounted to inner guide 42 and roller 10, may be used if desired.

I claim:

1. A forklift assembly for use in conjunction with a vehicle of the type having hitch means moveable in a generally vertical direction, the forklift assembly comprising:

a frame;

means for mounting said frame to the hitch means;

tine assembly means including a generally horizontal extension member moveably mounted parallel to a generally vertical first path along said frame;

roller means rotatably mounted to said frame;

a first cable having one end attached to and wrapped around said roller means in a first direction and having its other end attached to a point on said vehicle, said first direction chosen so that raising said frame along a generally vertical second path by the hitch means causes said first cable to unwind from said roller means; and means operably coupling said roller means and said tine assembly means for raising said tine assembly along said first path when said roller is rotated in a second direction, said second direction being opposite said first direction.

2. The forklift assembly of claim 1 wherein said tine assembly raising means includes a second cable, one end of which is attached to said roller and the other end of which is attached to said tine assembly means, so said second cable winds onto said roller means to raise said extension member relative to said frame along said first path when said roller is rotated in said second direction.

3. The forklift assembly of claim 1 wherein said extension member includes a plurality of horizontally extending tines.

4. The forklift assembly of claim 2 wherein said roller means includes a cylindrical roller around which said first and second cables are wrapped.

5. The forklift assembly of claim 2 including a plurality of second cables.

6. A forklift assembly for use in combination with a tractor of the type having a hitch including power driven lift arms, the outer ends of said arms being movable along a generally vertical, typically arcuate path, the forklift assembly comprising:

a frame including a generally vertical path means;

means for mounting said frame to the outer ends of said arms;

at least one generally horizontally extending product support member;

means for slidably mounting said product support member to said frame for movement along said path means;

a roller rotatably mounted to said frame;

a first cable, one end attached to said roller and wound around said roller in a first direction, the other end attached to an attachment point on said tractor vertically below said roller, said first direction chosen so said first cable unwinds from said roller when the distance between said roller and said attachment point is increased; and a plurality of second cables each having one end attached to said roller with the other end of each attached either to said slidable mounting means or to said product support member, said second cables adapted to wind onto said roller when said first cables unwind from said roller, whereby upward movement of the arms of the hitch moves said frame therewith causing said first cable to unwind from said roller as the distance between said roller and the attachment point increases so said second cables are wound onto said roller thereby raising said product support member along said path means on said frame.

7. The forklift assembly of claim 6 including a pair of tines and a pair of second cables.

* * * * *